US010398187B1

(12) United States Patent
Shaffer

(10) Patent No.: US 10,398,187 B1
(45) Date of Patent: Sep. 3, 2019

(54) ADJUSTABLE ELASTOMERIC HELMET MULTI-LINER RETAINER AND METHOD OF ASSEMBLING MULTI-LINER HELMET

(71) Applicant: Bell Sports, Inc., Scotts Valley, CA (US)

(72) Inventor: Samuel J. Shaffer, Santa Cruz, CA (US)

(73) Assignee: Bell Sports, Inc, Scotts Valley, CA (US)

( * ) Notice: Subject to any disclaimer, the term of this patent is extended or adjusted under 35 U.S.C. 154(b) by 123 days.

(21) Appl. No.: 15/621,948

(22) Filed: Jun. 13, 2017

(51) Int. Cl.

| | |
|---|---|
| ***A42B 3/08*** | (2006.01) |
| ***A42B 3/12*** | (2006.01) |
| ***A42B 3/06*** | (2006.01) |
| ***A42B 3/14*** | (2006.01) |

(52) U.S. Cl.
CPC ..... *A42B 3/12* (2013.01); *A42B 3/063* (2013.01); *A42B 3/145* (2013.01); *A42B 3/08* (2013.01); *A42B 3/124* (2013.01)

(58) Field of Classification Search
CPC ..... A42B 3/12; A42B 3/061; A42B 3/063; A42B 3/145; A42B 3/08; A42B 3/124
USPC ..... 2/411
See application file for complete search history.

(56) References Cited

U.S. PATENT DOCUMENTS

| | | | | |
|---|---|---|---|---|
| 5,204,998 | A * | 4/1993 | Liu | F16F 1/3732 2/411 |
| 5,603,117 | A | 2/1997 | Hudner, Jr. et al. | |
| 6,154,889 | A | 12/2000 | Moore, III et al. | |
| 8,316,512 | B2 | 11/2012 | Halldin | |
| 2011/0047678 | A1* | 3/2011 | Barth | A42B 3/124 2/411 |
| 2016/0262483 | A1* | 9/2016 | Cheng | A42B 3/04 |
| 2016/0316847 | A1 | 11/2016 | Weber et al. | |
| 2018/0206584 | A1* | 7/2018 | Allen | A42B 3/06 |

FOREIGN PATENT DOCUMENTS

| | | |
|---|---|---|
| RU | 2150874 | 6/2000 |
| WO | 2015085294 | 6/2015 |

* cited by examiner

*Primary Examiner* — Katherine M Moran
(74) *Attorney, Agent, or Firm* — Booth Udall Fuller, PLC

(57) ABSTRACT

A helmet body with an outer shell and at least two energy management liners may include an elastomeric shaft, a fixed retainer, and an adjustable retainer. The elastomeric shaft has a head, a tail, and a plurality of frustoconical ridges disposed along the elastomeric shaft between the head and the tail, the elastomeric shaft being narrower at the tail than at the head. The fixed retainer has first opening large enough to receive both the head, but a second opening is smaller than a size of the head. The adjustable retainer may have an aperture sized to receive the tail and part of the elastomeric shaft. The inner liner and the outer liner are coupled together with the fixed retainer on one side, the elastomeric shaft extending through the fixed retainer, the inner liner, and the outer liner and the adjustable retainer around the elastomeric shaft on the other side.

20 Claims, 10 Drawing Sheets

ADJUSTABLE ELASTOMERIC HELMET MULTI-LINER RETAINER AND METHOD OF ASSEMBLING MULTI-LINER HELMET

TECHNICAL FIELD

Aspects of this document relate generally to attaching multiple helmet liners together, and more specifically to a helmet liner retainer for assembling a multi-liner helmet and attaching components to the helmet body.

BACKGROUND

Protective headgear and helmets have wide uses. Multiple liners are used for comfort and protection. To assemble a multi-liner helmet, the liners are glued or otherwise permanently fixed together into a rigid form. Because a rigid helmet body does not address rotational impacts, an additional liner may be included for the purpose of addressing such impacts. As a result, the volume of the helmet body is generally increased. Components of the helmet also often need to be attached to the helmet body. The liners are not readily provided with external attachment for parts. The attachment couplings for external parts can be in-molded in the liner, but it is difficult due to manufacturing constraints. Addition of attachment locations for parts also increases the number of parts needed for assembling a helmet.

SUMMARY

According to an aspect of the disclosure, a helmet may comprise a helmet body, a fit system, and a helmet retainer. The helmet body may comprise an outer shell and at least two energy management liners inside the outer shell including an outer liner disposed inside the outer shell and an inner liner disposed inside the outer liner. The fit system may be disposed within the inner liner and coupled to the helmet body. The helmet liner retainer may comprise an elastomeric shaft, a fixed retainer, and an adjustable retainer. The elastomeric shaft may comprise a head, a tail, and a plurality of frustoconical ridges disposed along the elastomeric shaft between the head and the tail, wherein the elastomeric shaft may be narrower at the tail than at the head. The fixed retainer may comprise a first opening sized large enough to receive both the head and the tail therethrough, and a second opening sized large enough to receive the tail therethrough but smaller than a size of the head. The adjustable retainer may comprise an aperture through the adjustable retainer, wherein the aperture may be sized to receive the tail and a portion of the elastomeric shaft therethrough. The inner liner and the outer liner may be coupled together with at least a portion of the fixed retainer disposed within the inner liner, the elastomeric shaft extending through the fixed retainer, the inner liner, and the outer liner with the adjustable retainer disposed around the elastomeric shaft on an outer surface of the outer liner.

Particular embodiments may comprise one or more of the following. The first opening of the fixed retainer may comprise a female snap. The female snap may be configured to mate with a male snap of a comfort liner. The female snap may be configured to mate with a male snap of a multi-directional impact protection system. The inner liner may be a multi-directional impact protection system. The fixed retainer may be in-molded into the inner liner. The outer liner may comprise a recess on an inner surface, and the inner liner may comprise a protrusion on an outer surface aligned with the recess on the inner surface of the outer liner, the recess being larger than the protrusion to allow limited rotational movement between the inner liner and the outer liner.

According to an aspect of the disclosure, a helmet liner retainer may comprise an elastomeric shaft, a fixed retainer, and an adjustable retainer. The elastomeric shaft may comprise a head, a tail, and a plurality of frustoconical ridges along the elastomeric shaft between the head and the tail, wherein the elastomeric shaft may be narrower at the tail than at the head. The fixed retainer may comprise a first opening sized large enough to receive the head and the tail therethrough, and a second opening sized large enough to receive the tail therethrough but smaller than a size of the head. The adjustable retainer may comprise an aperture through the adjustable retainer, wherein the aperture may be sized to receive the tail and a portion of the elastomeric shaft therethrough.

Particular embodiments may comprise one or more of the following. The first opening may further comprise a female snap. The female snap may be configured to mate with a male snap of a comfort liner of a helmet. The female snap may be configured to mate with a male snap of a multi-directional impact protection system of a helmet.

According to an aspect of the disclosure, a method of assembling a multi-liner helmet may comprise providing at least two helmet liners, passing an elastomeric shaft, and slidably attaching an adjustable retainer. Passing an elastomeric shaft may comprise passing an elastomeric shaft through a fixed retainer in an innermost liner or an outermost liner of the helmet liners and through the helmet liners so that a head end of the elastomeric shaft rests against the fixed retainer. Slidably attaching adjustable retainer may comprise slidably attaching an adjustable retainer to a tail end of the elastomeric shaft, opposite the head end, through an aperture of the adjustable retainer by sliding the adjustable retainer along the elastomeric shaft from the tail end until the adjustable retainer reaches a frustoconical ridge of the elastomeric shaft proximate to the outermost liner or the innermost liner.

Particular embodiments may comprise one or more of the following. Providing at least two helmet liners may comprise providing a multi-directional impact protection system, and passing an elastomeric shaft comprises placing the multi-directional impact protection system innermost among the helmet liners. Passing an elastomeric shaft may comprise passing the elastomeric shaft through the fixed retainer in the innermost liner, and slidably attaching an adjustable retainer may further comprise snapping a male snap of a comfort liner into a female snap on a first opening of the fixed retainer. Passing an elastomeric shaft may comprise passing the elastomeric shaft through the fixed retainer in the innermost liner, and slidably attaching an adjustable retainer may further comprise snapping a male snap of a multi-directional impact protection system into a female snap on a first opening of the fixed retainer.

According to an aspect of the disclosure, a helmet may comprise a helmet body, a fit system, and a helmet liner retainer. The helmet body may comprise an outer shell and at least two energy management liners inside the outer shell including an outer liner disposed inside the outer shell and an inner liner disposed inside the outer liner. The fit system may be disposed within the inner liner and coupled to the helmet body. The helmet liner retainer may comprise an elastomeric shaft, a fixed retainer, and an adjustable retainer. The elastomeric shaft may comprise a head, a tail, and a plurality of frustoconical ridges disposed along the elastomeric shaft between the head and the tail, wherein the elastomeric shaft may be narrower at the tail than at the head. The fixed retainer may comprise a second opening sized large enough to receive the tail therethrough but smaller than a size of the head. The adjustable retainer may comprise an aperture through the adjustable retainer, wherein the aperture may be sized to receive the tail and a portion of the elastomeric shaft therethrough. The energy management liners may be coupled together with at least a portion of the fixed retainer disposed within the inner liner or outside the outer liner, and the elastomeric shaft extending through the fixed retainer, the inner liner, and the outer liner with the adjustable retainer disposed around the elastomeric shaft on an outer surface of the outer liner or an inner surface of the inner liner.

Particular embodiments may comprise one or more of the following. The fixed retainer may further comprise a first opening sized large enough to receive both the head and the tail therethrough, and the first opening further may comprise a female snap. The fixed retainer may be disposed within the inner liner, and the female snap may be configured to mate with a male snap of a comfort liner. The fixed retainer may be disposed within the inner liner, and the female snap may be configured to mate with a male snap of a multi-directional impact protection system. The inner liner may comprise a multi-directional impact protection system.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
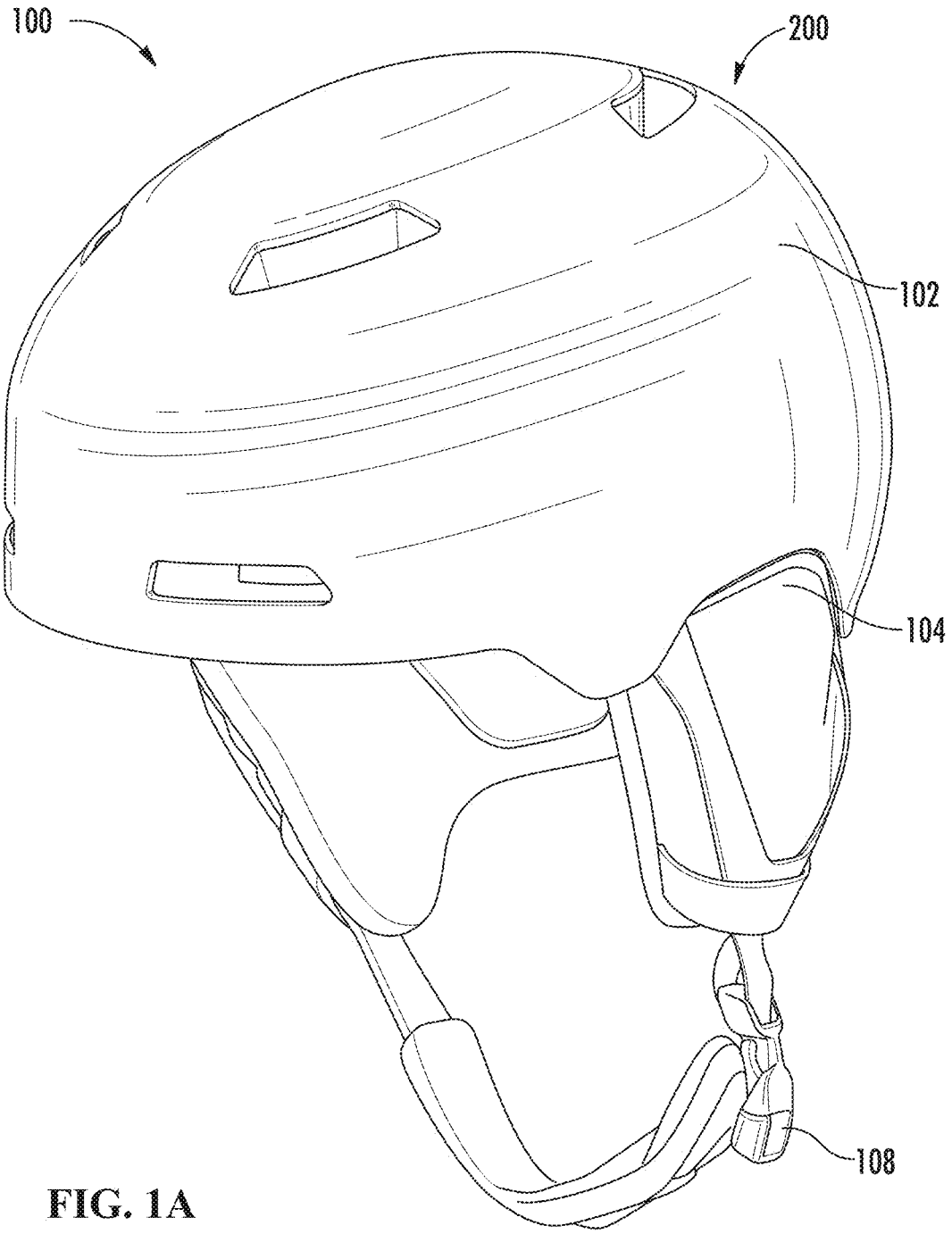
FIG. 1A is a perspective view of a multi-liner helmet.

While this disclosure includes embodiments in many different forms, they are shown in the drawings and will herein be described in detailed particular embodiments with the understanding that the present disclosure is to be considered as an exemplification of the principles of the disclosed methods and systems, and is not intended to limit the broad aspect of the disclosed concepts to the embodiments illustrated.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a user to releasably wear their helmet, and to ensure the helmet remains on the user's head during an impact.

Protective headgear or helmets can be used for a snow skier, a cyclist, football player, hockey player, baseball player, lacrosse player, polo player, climber, auto racer, motorcycle rider, motocross racer, snowboarder or other snow or water athlete, sky diver or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. ventilation, size, etc.). Some helmets are made of two or more bodies of energy-absorbing material formed in shapes that would be difficult, if not impossible, to achieve in a single molded piece.

Various implementations and embodiments of protective helmets according to this disclosure comprise a protective shell. The protective shell may be formed of an energy absorbing material such as expanded polystyrene (EPS), expanded polyurethane (EPU), expanded polyolefin (EPO), expanded polypropylene (EPP), or other suitable material. The energy absorbing material can be used as part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material may comprise one or more layers of EPP and provide more flexibility than available with conventional in-molded helmets. Alternatively, the energy absorbing material may be part of an in-molded helmet such as a bicycle helmet or cycling helmet. As an energy-absorbing layer in an in-molded helmet, the protective shell may comprise rigid materials such as EPS and EPU. An outer shell layer, such as a layer of stamped polyethylene terephthalate (PET) or a polycarbonate shell, may be included on an outer surface of the protective shell of the helmet and be bonded directly to the expanding foam (e.g. EPS as it is expanding such that the foam is molded in the shell).

Contemplated as part of this disclosure is a helmet liner retainer that is used to assemble a multi-liner helmet, attach helmet components to the helmet body, and address rotational impacts with a multi-liner helmet, as well as a method of assembling a multi-liner helmet using a helmet liner retainer.

Figure 1B:
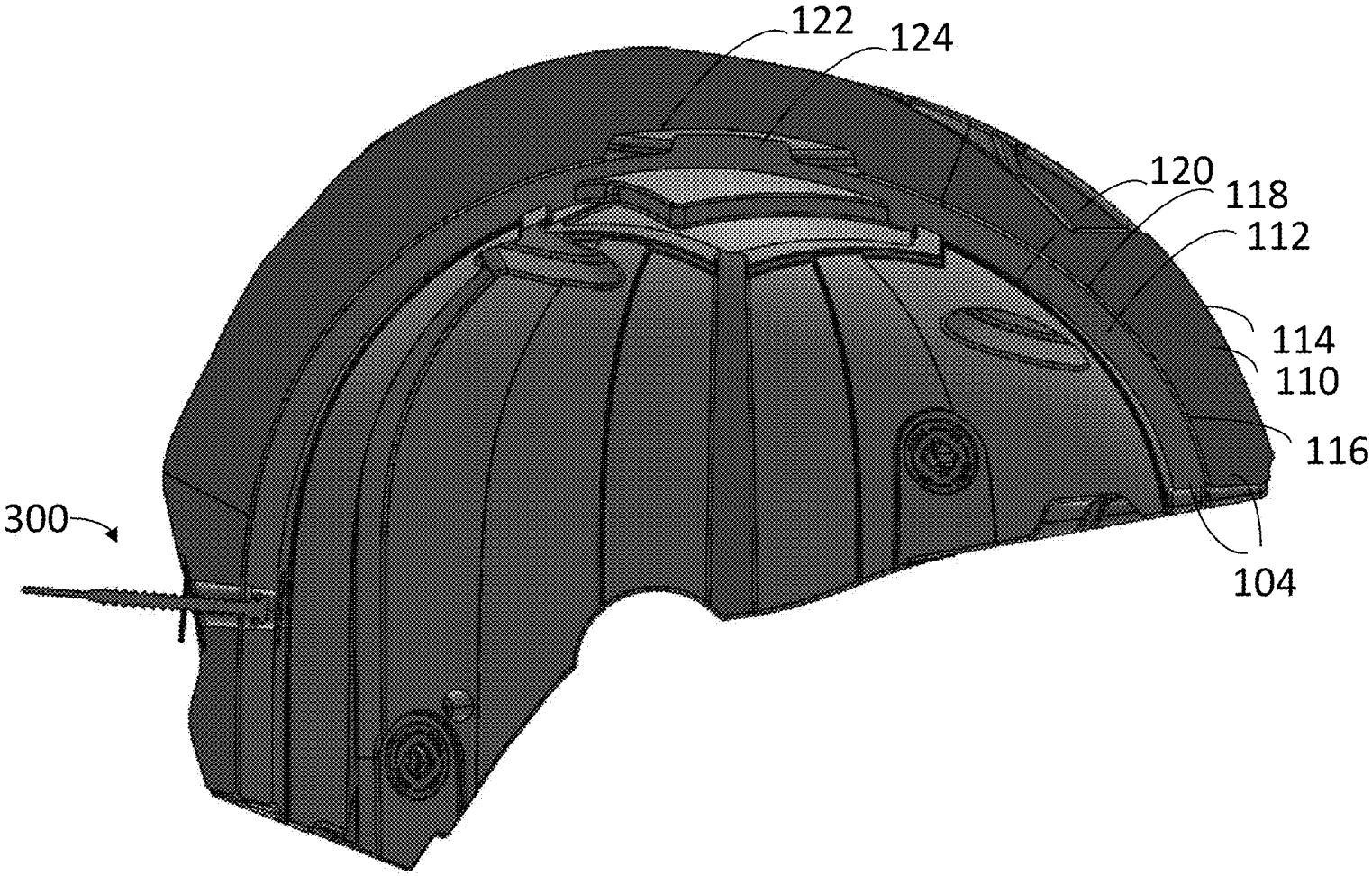
FIG. 1B is a cross-sectional view of the helmet shown in FIG. 1A.
Figure 1C:
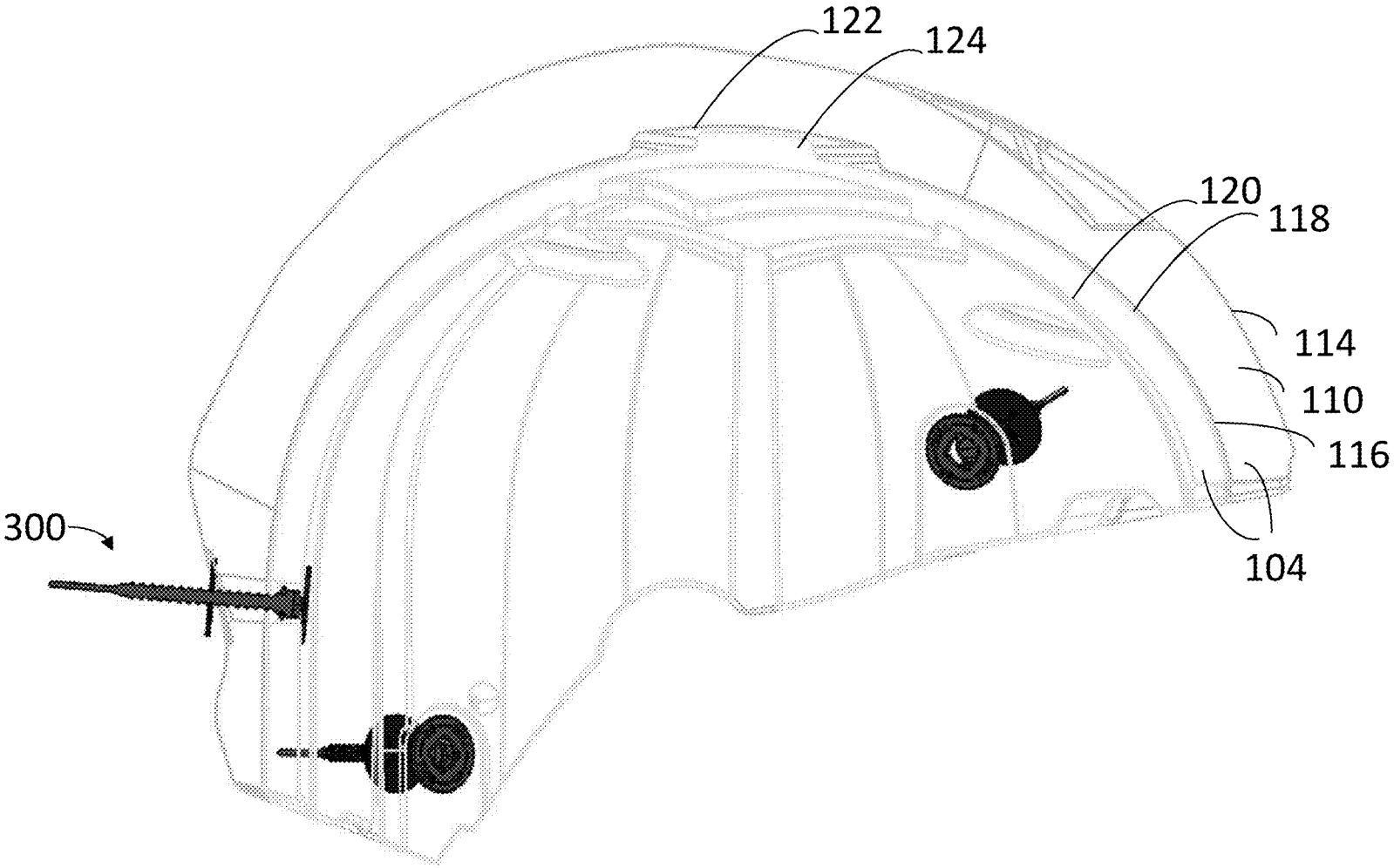
FIG. 1C is a transparent cross-sectional view of the helmet shown in FIG. 1A.

A helmet 100 may comprise a helmet body 200, a fit system 108, and a helmet liner retainer 300. FIG. 1A illustrates an example of a helmet 100, FIG. 1B shows a cross-sectional view of the helmet 100 shown in FIG. 1A, and FIG. 1C shows a transparent cross-sectional view of the helmet 100 shown in FIG. 1A. The helmet body 200 may comprise an outer shell 102, or may be formed without an outer shell 102, and comprises two or more energy-management layers 104 inside the outer shell 102. The energy management liners 104 include an outer liner 110 and an inner liner 112. The outer liner 110 is disposed inside the outer shell 102, if included, and the inner liner 112 is disposed inside the outer liner 110. A fit system 108 is generally disposed within the inner liner 112 and coupled to the helmet body 200.

The outer liner 110 comprises an outer surface 114 and an inner surface 116. The inner liner 112 also comprises an outer surface 118 and an inner surface 120. The inner liner may be a multi-directional impact protection system, such as that manufactured and licensed by MIPS AB of Sweden. In particular embodiments such as the one illustrated in FIG. 1B, the outer liner 110 comprises a recess 122 on the inner surface 116 of the outer liner 110. In such embodiments, the inner liner 112 comprises a protrusion 124 on the outer surface 118 of the inner liner 112 that is aligned with the recess 122. The recess 122 is larger than the protrusion 124 to allow limited rotational movement between the inner liner 112 and the outer liner 110. In other embodiments, the protrusion 124 and corresponding recess 122 are not used.

Figure 2A:
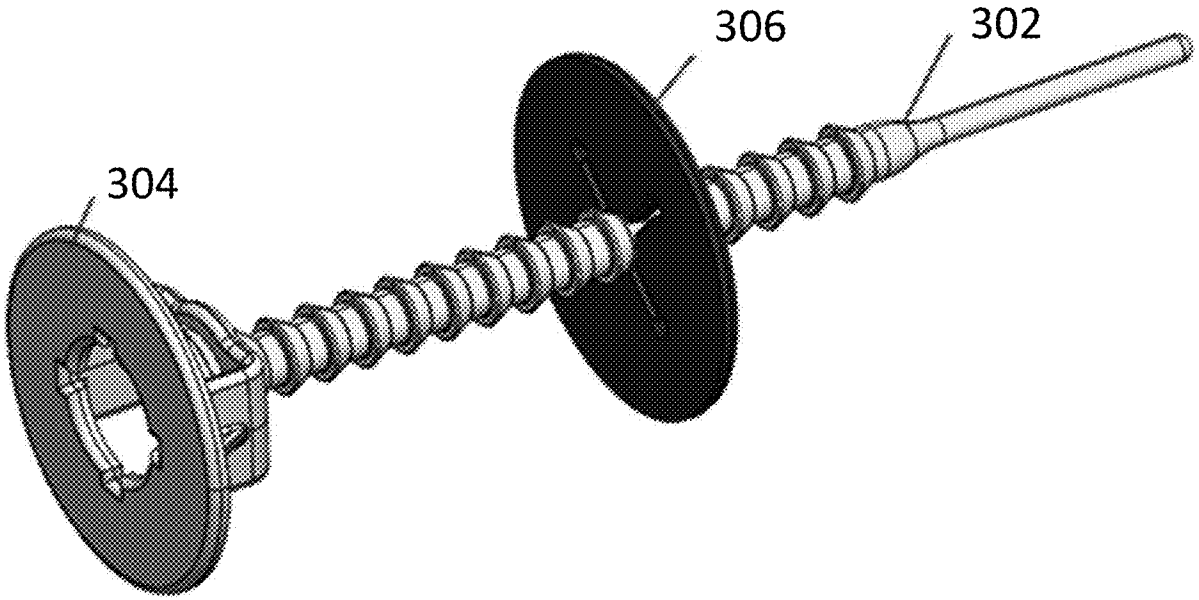
FIG. 2A shows a front perspective view of a helmet liner retainer.
Figure 2B:
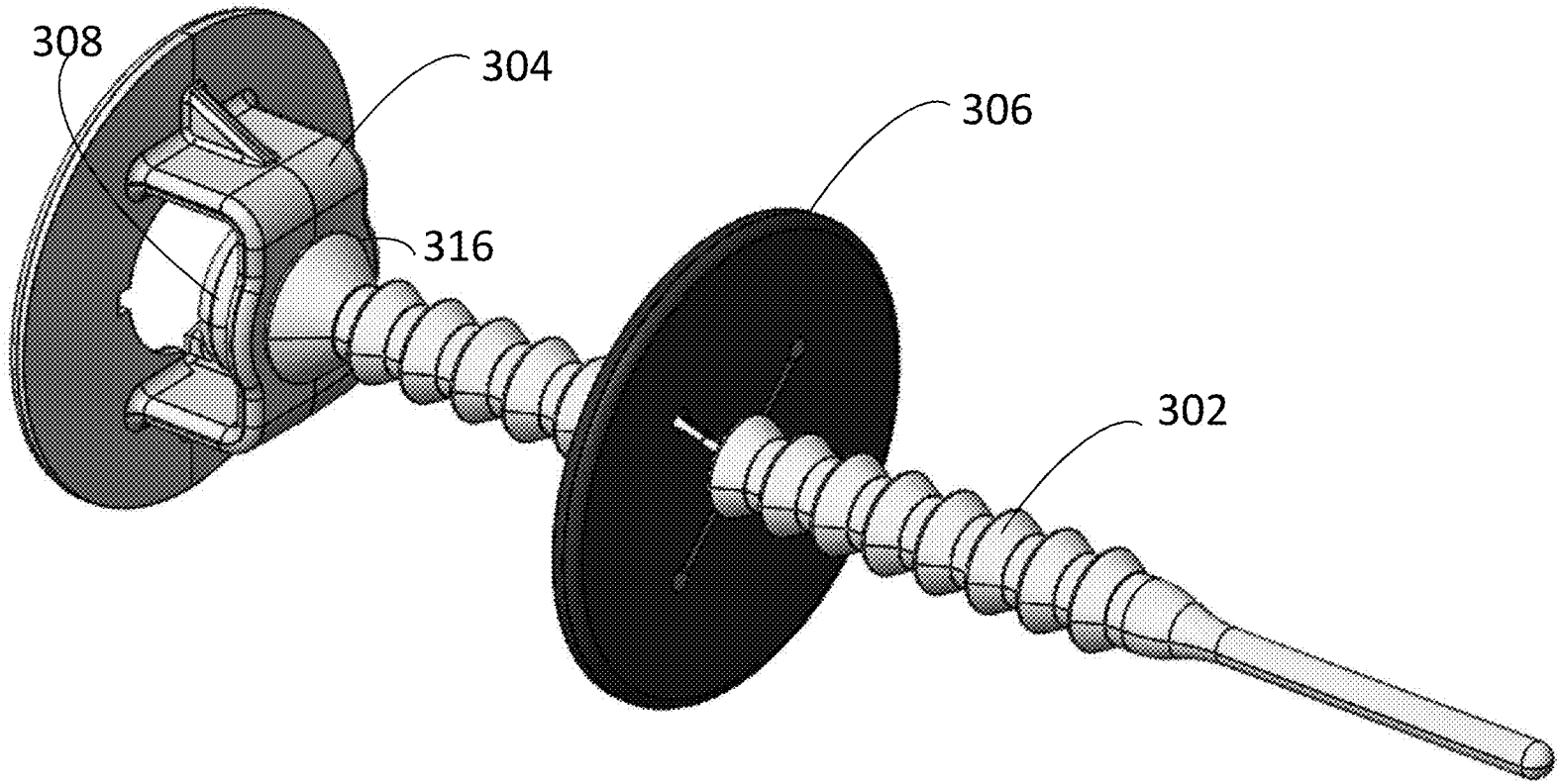
FIG. 2B is the rear perspective view of the helmet liner retainer shown in FIG. 2A.

A helmet liner retainer 300 is included to couple the outer liner 110 to the inner liner 112. As illustrated in FIGS. 1B-3C, the helmet liner retainer 300 may comprise an elastomeric shaft 302, a fixed retainer 304, and an adjustable retainer 306. FIG. 2A illustrates a front perspective view of an example of a helmet liner retainer 300, and FIG. 2B shows a rear perspective view of the helmet liner retainer 300 shown in FIG. 2A.

Figure 3B:
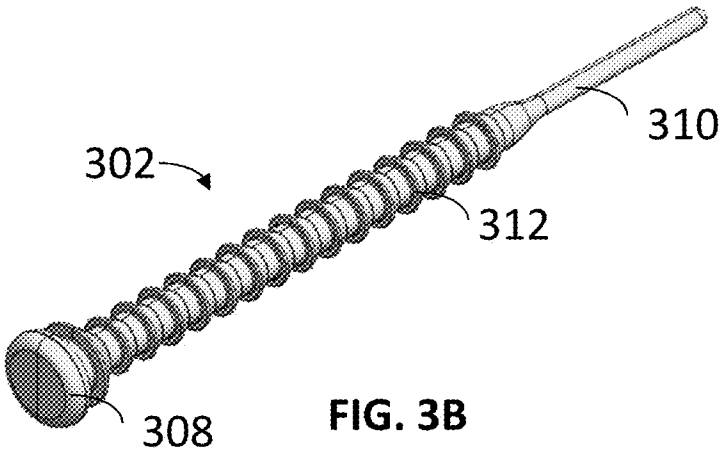
FIG. 3B is the front perspective view of the elastomeric shaft shown in FIG. 3A.
Figure 3A:
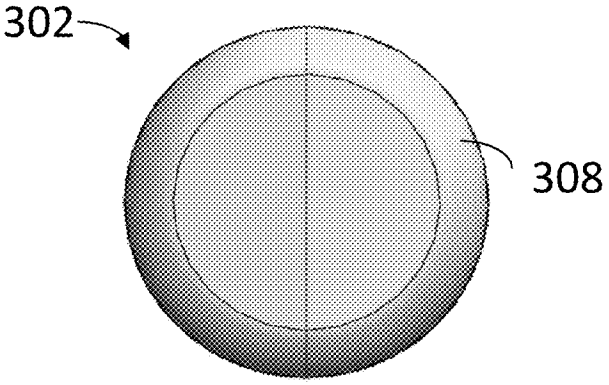
FIG. 3A shows the front view of an elastomeric shaft.
Figure 3C:
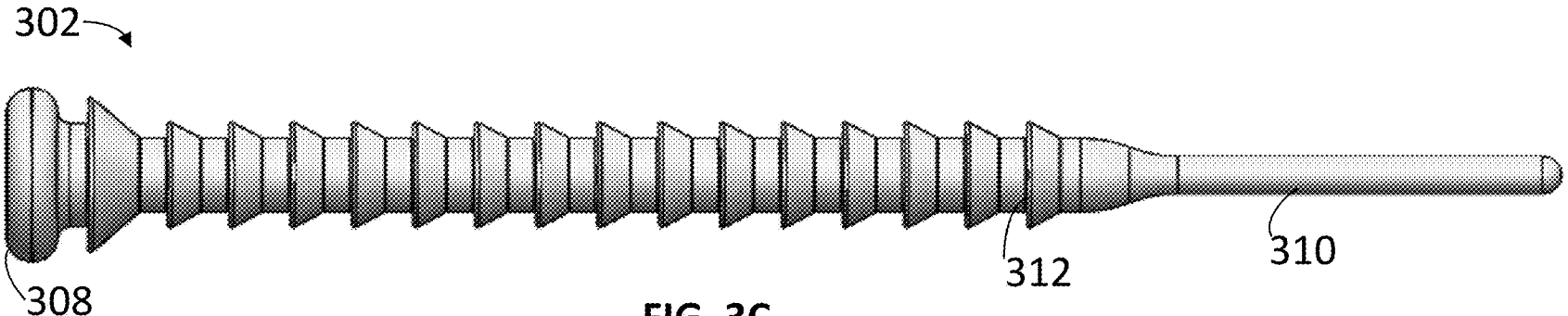
FIG. 3C is the side view of the elastomeric shaft shown in FIG. 3A.

The elastomeric shaft 302 comprises a head or head end 308, a tail or tail end 310, and a plurality of frustoconical ridges 312 (FIGS. 3A-3C). The ridges 312 are disposed along the elastomeric shaft 302 between the head 308 and the tail 310. The elastomeric shaft 302 is configured to be narrower at the tail 310 than at the head 308.

Figure 4A:
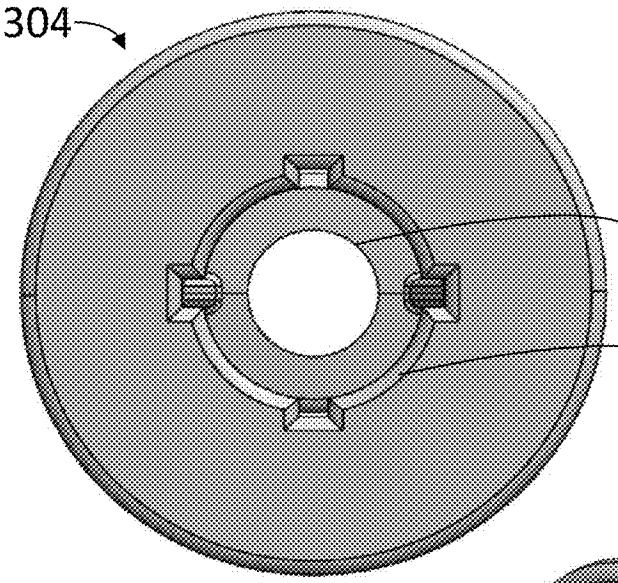
FIG. 4A is a front view of a fixed retainer.
Figure 4B:
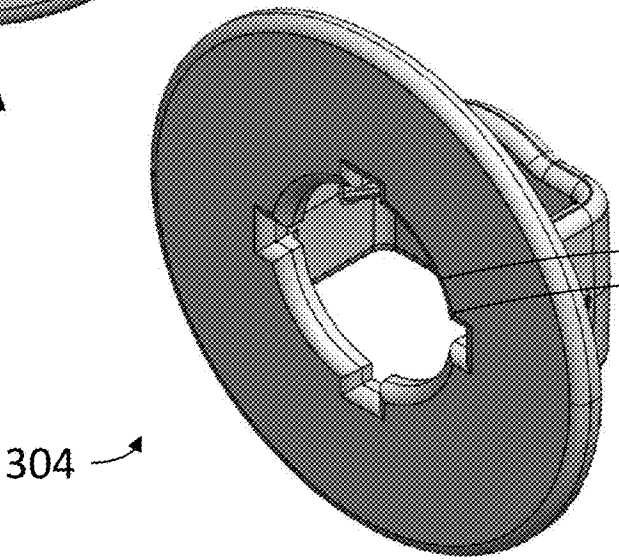
FIG. 4B is the front perspective view of the fixed retainer shown in FIG. 4B.
Figure 4C:
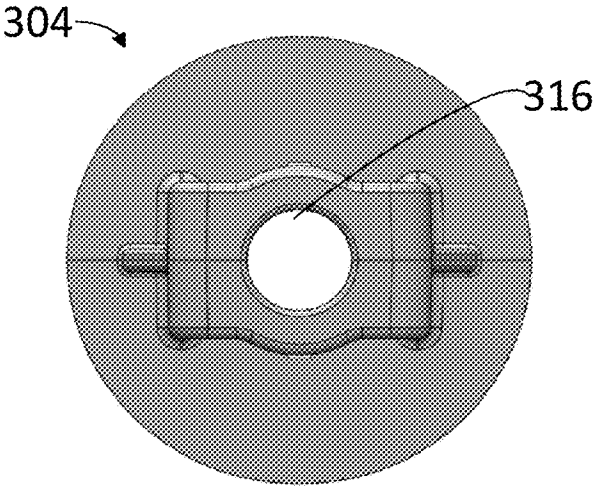
FIG. 4C is the rear view of the fixed retainer shown in FIG. 4A.

The fixed retainer 304 may comprise a second opening 316 (FIGS. 4A-4C). The second opening 316 is sized large enough to receive the tail 310 therethrough but smaller than the size of the head 308 so that the fixed retainer 304 holds the elastomeric shaft 302 by the head 308 (FIG. 2B). The fixed retainer and the elastomeric shaft may alternatively be molded as one part.

Figure 5B:
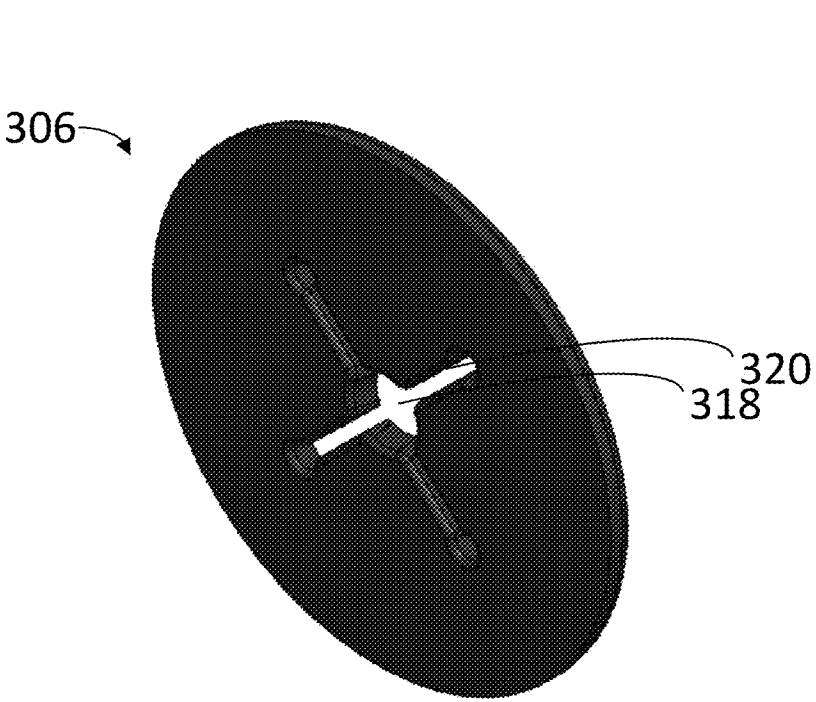
FIG. 5B is the perspective view of the adjustable retainer shown in FIG. 5A.
Figure 5A:
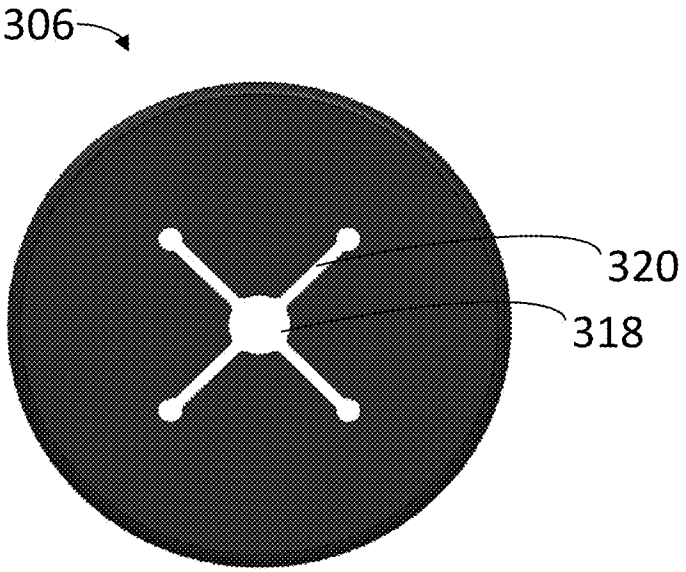
FIG. 5A is the front view of an adjustable retainer.

The adjustable retainer 306 of the example of FIGS. 5A-5B comprises an aperture 318 through the adjustable retainer 306 (FIGS. 5A-5B). The aperture is sized to receive the tail 310 and a portion of the elastomeric shaft 302 there through without deformation. The cross-section of the elastomeric shaft can be formed round, square, rectangular, oval, diamond, polygonal, or any other shape as long as the shaft can pass through the aperture. The adjustable retainer 306 includes one or more slit 320 cross the aperture 318. The slits 320 help the adjustable retainer 306 to deform to allow the aperture 318 to expand when the ridges 312 of the elastomeric shaft pass through the aperture 318.

In the embodiment of FIGS. 1A-1C, the helmet liner retainer 300 is used to assemble the energy management liners 110, 112 into the helmet 100. The liners 110, 112 have corresponding and respective holes through them that allow the elastomeric shaft to pass through, joining the liners 110, 112. The inner liner 112 and the outer liner 110 can be coupled together with at least a portion of the fixed retainer 304 disposed within the inner liner 112, the elastomeric shaft 302 extending through the fixed retainer 304, the inner liner 112, and the outer liner 110 with the adjustable retainer 306 disposed around the elastomeric shaft 302 on the outer surface 114 of the outer liner 110. In some instances, the helmet liner retainer 300 can pass through the liners 104 the other way around such that at least a portion of the fixed retainer 304 is disposed outside the outer liner 110, and after the elastomeric shaft 302 extends through the fixed retainer 304, the outer liner 110, and the inner liner 112, the adjustable retainer 306 is disposed around the elastomeric shaft 302 on an inner surface 120 of the inner liner 112. The helmet liner retainer can be used on a helmet with or without an outer shell, and with or without an energy management liner being in-molded to a shell, because the helmet liner retainer can be secured from the outside of the outer liner and the inside of the inner liner. The helmet liner retainer can be used on any helmet with a multi-liner construction, regardless of the geometry, thickness, and number of liners. The assembly of a multi-liner helmet is therefore simplified.

A multi-liner helmet assembled with a helmet liner retainer can be used to address and control the rotational movement between the liners, which includes the liners sliding against and in relation to each other. When the liners are assembled by a helmet liner retainer, the elastomeric shaft allows rotational movement due to the elastomeric property of the shaft, but the rotational movement is dampened and controlled because the elastomeric shaft provides resistance to the sliding force. The elastomeric property of the elastomeric shaft also helps the liners return back to their original positions after the rotational movement. With the helmet liner retainer, an energy management layer can be used to address rotational impacts to a wearer's head without an additional slip layer between the helmet and the wearer's head to reduce the overall thickness of the helmet on the wearer's head.

Figure 6B:
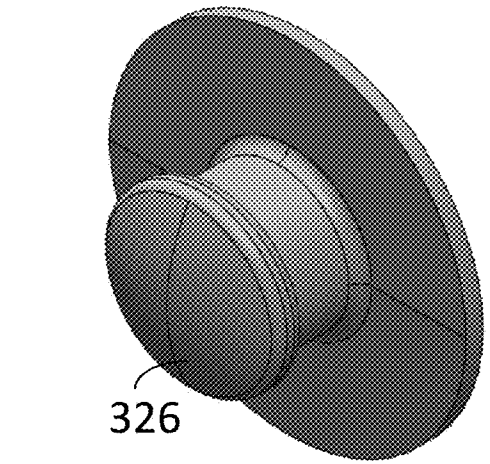
FIG. 6B is the rear perspective view of the male snap shown in FIG. 6A.
Figure 6A:
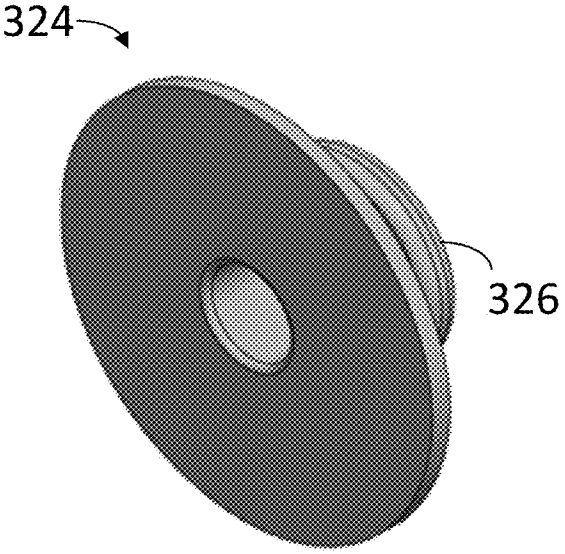
FIG. 6A is a front perspective view of a male snap.

The helmet liner retainer 300 can also be used to attach components of the helmet 100 to the helmet body 200, make all attachment points easily accessible during assembly, and reduce the number of parts required to assemble a helmet. In some embodiments, the fixed retainer 304 may further comprise a first opening 314 (FIGS. 4A-4C) sized large enough to receive both the head 308 and the tail 310 therethrough. The first opening 314 can comprise a female portion of a snap 322. The female snap 322 is configured to mate with a male portion of a snap 324 (FIGS. 6A-6B). The male snap 324 may comprise an enlarged tip 326 or other configuration to allow it to be retained within the female snap 322. The enlarged tip 326 may be formed of an elastic material and be sized bigger than the female snap 322 such that the enlarged tip 326 fits through the female snap 322 and afterward rests against the female snap 322. The male snap 324 may be coupled to a comfort liner. The male snap 324 can also be coupled to an additional multi-directional impact protection system within the helmet, such as that manufactured and licensed by MIPS AB of Sweden. In some instances, the fixed retainer may further comprise magnets, hook-and-loop mechanisms, or other attachment mechanisms known to a person skilled in the art for attaching helmet components onto the helmet body. The fixed retainer 304 may be in-molded into the inner liner 112 or the outer liner 110, which can help to hold the assembly of the liners or connections of the components to the helmet body in place.

Figure 7:
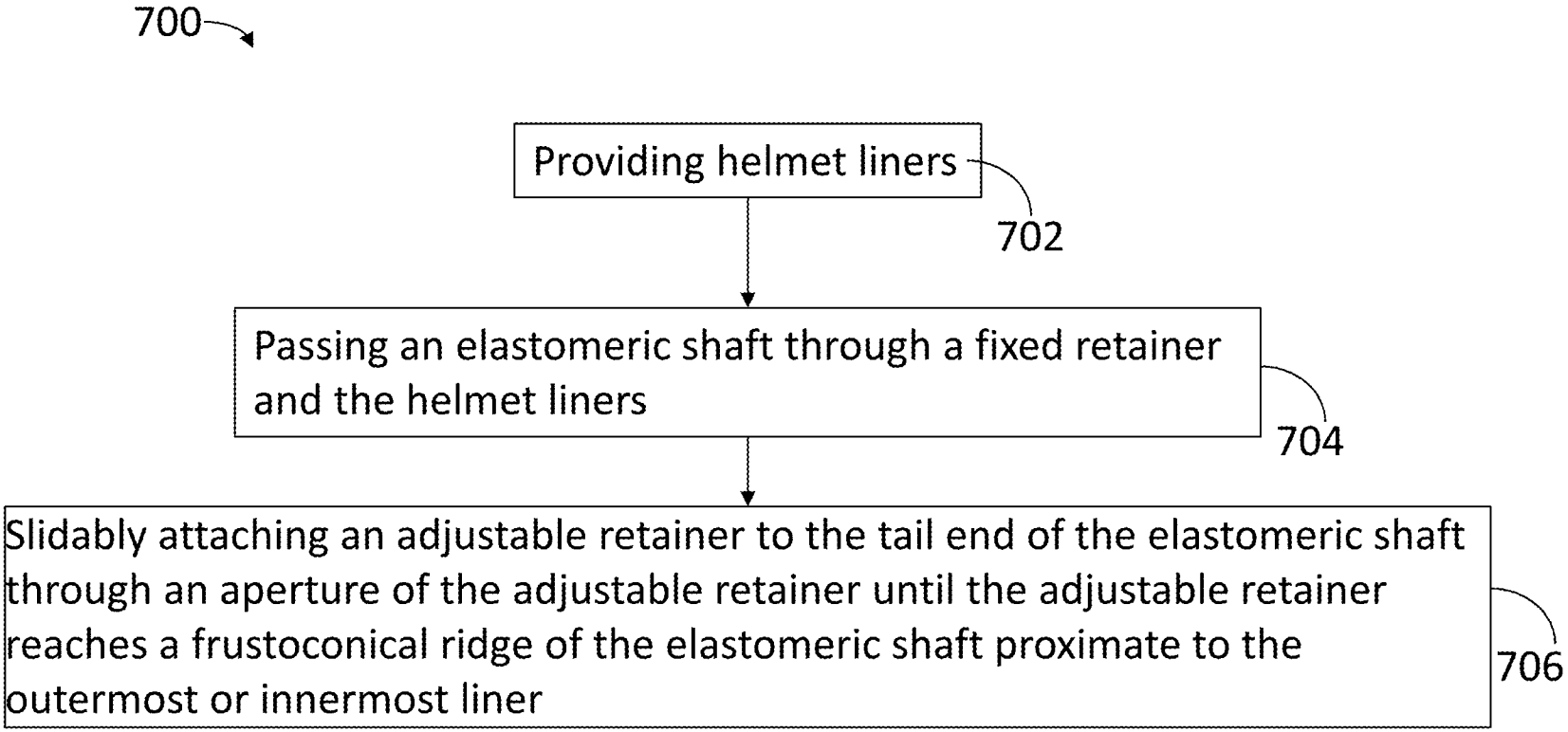
FIG. 7 is a flow diagram of a method of attaching helmet liners.

Methods of assembling a multi-liner helmet are also provided herein. FIG. 7 illustrates an additional example of a method of assembling a multi-liner helmet (700). The method comprises providing at least two helmet liners (702), passing an elastomeric shaft through a fixed retainer in an innermost or outermost liner of the helmet liners and through the helmet liners so that the head end of the elastomeric shaft rests against the fixed retainer (704), and slidably attaching an adjustable retainer to the tail end of the elastomeric shaft, opposite the head end, through the aperture of the adjustable retainer by sliding the adjustable retainer along the elastomeric shaft from the tail end until the adjustable retainer reaches a frustoconical ridge of the elastomeric shaft proximate to the outermost liner or the innermost liner (706). Providing at least two helmet liners (702) may include providing an additional multi-directional impact protection system as one of the helmet liners. In some embodiments, passing an elastomeric shaft (704) may further comprise passing the elastomeric shaft through the fixed retainer in the innermost liner, and slidably attaching an adjustable retainer (706) may further comprise snapping a male snap of a comfort liner into a female snap of a first opening of the fixed retainer. In some embodiments, passing an elastomeric shaft (704) may further comprise passing the elastomeric shaft through the fixed retainer in the innermost liner, and slidably attaching an adjustable retainer (706) can further comprise snapping a male snap of an multi-directional impact protection system into a female snap on a first opening of the fixed retainer.

This disclosure, its aspects and implementations, are not limited to the specific components or assembly procedures disclosed herein. Many additional components and assembly procedures known in the art consistent with the intended helmets, helmet liner retainers, and methods of assembling a multi-liner helmet will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets, helmet liner retainers, and methods of assembling a helmet are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet, helmet liner retainers, and methods of assembling a helmet may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

The invention claimed is:

1. A helmet comprising:

a helmet body comprising an outer shell and at least two energy management liners inside the outer shell including an outer liner disposed inside the outer shell and an inner liner disposed inside the outer liner;

a fit system disposed within the inner liner and coupled to the helmet body; and a helmet liner retainer comprising:

an elastomeric shaft, comprising a head, a tail, and a plurality of frustoconical ridges disposed along the elastomeric shaft between the head and the tail, wherein the elastomeric shaft is narrower at the tail than at the head;

a fixed retainer comprising a first opening sized large enough to receive both the head and the tail therethrough, and a second opening sized large enough to receive the tail therethrough but smaller than a size of the head; and an adjustable retainer comprising an aperture through the adjustable retainer, wherein the aperture is sized to receive the tail and a portion of the elastomeric shaft therethrough;

wherein the inner liner and the outer liner are coupled together with at least a portion of the fixed retainer disposed within the inner liner, the elastomeric shaft extending through the fixed retainer, the inner liner, and the outer liner with the adjustable retainer disposed around the elastomeric shaft on an outer surface of the outer liner.

2. The helmet of claim 1, wherein the first opening of the fixed retainer comprises a female snap.

3. The helmet of claim 2, wherein the female snap is configured to mate with a male snap of a comfort liner.

4. The helmet of claim 2, wherein the female snap is configured to mate with a male snap of a multi-directional impact protection system.

5. The helmet of claim 1, wherein the inner liner is a multi-directional impact protection system.

6. The helmet of claim 1, wherein the fixed retainer is in-molded into the inner liner.

7. The helmet of claim 1, wherein the outer liner comprises a recess on an inner surface, and the inner liner comprises a protrusion on an outer surface aligned with the recess on the inner surface of the outer liner, the recess being larger than the protrusion to allow limited rotational movement between the inner liner and the outer liner.

8. A helmet comprising:

a helmet body comprising an outer shell and at least two energy management liners inside the outer shell including an outer liner disposed inside the outer shell and an inner liner disposed inside the outer liner;

an elastomeric shaft, comprising a head, a tail, and a plurality of frustoconical ridges along the elastomeric shaft between the head and the tail, wherein the elastomeric shaft is narrower at the tail than at the head;

a fixed retainer comprising a first opening sized large enough to receive the head and the tail therethrough, and a second opening sized large enough to receive the tail therethrough but smaller than a size of the head; and an adjustable retainer comprising an aperture through the adjustable retainer, wherein the aperture is sized to receive the tail and a portion of the elastomeric shaft therethrough;

wherein the inner liner and the outer liner are coupled together with at least a portion of the fixed retainer disposed within the inner liner, the elastomeric shaft extending through the fixed retainer, the inner liner, and the outer liner with the adjustable retainer disposed around the elastomeric shaft on an outer surface of the outer liner.

9. The helmet of claim 8, wherein the first opening further comprises a female snap.

10. The helmet of claim 9, wherein the female snap is configured to mate with a male snap of a comfort liner of the helmet.

11. The helmet of claim 9, wherein the female snap is configured to mate with a male snap of a multi-directional impact protection system of the helmet.

12. A method of assembling a multi-liner helmet, comprising:

providing at least two helmet liners;

passing an elastomeric shaft through a fixed retainer in an innermost liner or an outermost liner of the helmet liners and through the helmet liners so that a head end of the elastomeric shaft rests against the fixed retainer; and slidably attaching an adjustable retainer to a tail end of the elastomeric shaft, opposite the head end, through an aperture of the adjustable retainer by sliding the adjustable retainer along the elastomeric shaft from the tail end until the adjustable retainer reaches a frustoconical ridge of the elastomeric shaft proximate to the outermost liner or the innermost liner.

13. The method of claim 12, wherein providing at least two helmet liners comprises providing a multi-directional impact protection system, and passing an elastomeric shaft comprises placing the multi-directional impact protection system innermost among the helmet liners.

14. The method of claim 12, wherein passing an elastomeric shaft comprises passing the elastomeric shaft through the fixed retainer in the innermost liner, and slidably attaching an adjustable retainer further comprises snapping a male snap of a comfort liner into a female snap on a first opening of the fixed retainer.

15. The method of claim 12, wherein passing an elastomeric shaft comprises passing the elastomeric shaft through the fixed retainer in the innermost liner, and slidably attaching an adjustable retainer further comprises snapping a male snap of a multi-directional impact protection system into a female snap on a first opening of the fixed retainer.

16. A helmet comprising:

a helmet body comprising an outer shell and at least two energy management liners inside the outer shell including an outer liner disposed inside the outer shell and an inner liner disposed inside the outer liner;

a fit system disposed within the inner liner and coupled to the helmet body; and a helmet liner retainer comprising:

an elastomeric shaft, comprising a head, a tail, and a plurality of frustoconical ridges disposed along the elastomeric shaft between the head and the tail, wherein the elastomeric shaft is narrower at the tail than at the head;

a fixed retainer comprising a second opening sized large enough to receive the tail therethrough but smaller than a size of the head; and an adjustable retainer comprising an aperture through the adjustable retainer, wherein the aperture is sized to receive the tail and a portion of the elastomeric shaft therethrough;

wherein the energy management liners are coupled together with at least a portion of the fixed retainer disposed within the inner liner or outside the outer liner, and the elastomeric shaft extending through the fixed retainer, the inner liner, and the outer liner with the adjustable retainer disposed around the elastomeric shaft on an outer surface of the outer liner or an inner surface of the inner liner.

17. The helmet of claim 16, wherein the fixed retainer further comprises a first opening sized large enough to receive both the head and the tail therethrough, and the first opening further comprises a female snap.

18. The helmet of claim 17, wherein the fixed retainer is disposed within the inner liner, and the female snap is configured to mate with a male snap of a comfort liner.

19. The helmet of claim 17, wherein the fixed retainer is disposed within the inner liner, and the female snap is configured to mate with a male snap of a multi-directional impact protection system.

20. The helmet of claim 16, wherein the inner liner comprises a multi-directional impact protection system.

* * * * *